US009395117B2

(12) United States Patent
Kim et al.

(10) Patent No.: US 9,395,117 B2
(45) Date of Patent: Jul. 19, 2016

(54) REFRIGERATOR

(75) Inventors: Jun Hee Kim, Gyeongsangnam-do (KR); Ki Hong Park, Busan (KR); Min Hun Kim, Busan (KR); Sang Hu Park, Seoul (KR)

(73) Assignee: LG Electronics Inc., Seoul (KR)

( * ) Notice: Subject to any disclaimer, the term of this patent is extended or adjusted under 35 U.S.C. 154(b) by 1438 days.

(21) Appl. No.: 12/787,442

(22) Filed: May 26, 2010

(65) Prior Publication Data

US 2011/0018415 A1 Jan. 27, 2011

(30) Foreign Application Priority Data

Jul. 22, 2009 (KR) ..... 10-2009-0066837

(51) Int. Cl.

| | |
|---|---|
| ***A47B 96/04*** | (2006.01) |
| ***F25D 25/02*** | (2006.01) |
| ***A47B 88/12*** | (2006.01) |
| ***A47B 88/16*** | (2006.01) |
| ***F25D 23/02*** | (2006.01) |

(52) U.S. Cl.

CPC ..... *F25D 25/025* (2013.01); *A47B 88/12* (2013.01); *A47B 88/16* (2013.01); *F25D 23/021* (2013.01)

(58) Field of Classification Search

USPC ..... 312/402, 404, 334.27, 334.29, 334.31, 312/334.32, 334.34, 350, 330.1, 334.7, 312/334.1, 334.22, 401, 312; 62/378, 382

See application file for complete search history.

(56) References Cited

U.S. PATENT DOCUMENTS

| | | | | |
|---|---|---|---|---|
| 3,014,160 | A * | 12/1961 | Brogden | 361/727 |
| 3,289,044 | A * | 11/1966 | Ginsberg | 361/727 |
| 3,363,960 | A * | 1/1968 | Reiss et al. | 312/334.34 |
| 3,647,271 | A * | 3/1972 | Allred | 384/21 |
| 3,694,049 | A * | 9/1972 | Gutner | 312/334.27 |
| 4,389,079 | A * | 6/1983 | Cosme | 312/334.36 |
| 4,534,600 | A * | 8/1985 | Cosme | 384/23 |
| 4,751,826 | A * | 6/1988 | Kawahara et al. | 62/382 |
| 4,909,558 | A * | 3/1990 | Roshinsky | 296/37.6 |
| 6,447,083 | B1 * | 9/2002 | Chiapetta et al. | 312/404 |
| 7,028,503 | B2 * | 4/2006 | Lyvers et al. | 62/344 |
| 2006/0021373 | A1 * | 2/2006 | Oh et al. | 62/407 |
| 2006/0022564 | A1 * | 2/2006 | Oh et al. | 312/402 |
| 2006/0087208 | A1 * | 4/2006 | Oh et al. | 312/402 |
| 2007/0262686 | A1 * | 11/2007 | Ji | 312/402 |
| 2009/0243448 | A1 * | 10/2009 | Yu et al. | 312/319.5 |
| 2011/0050065 | A1 * | 3/2011 | Lee et al. | 312/402 |
| 2012/0262044 | A1 * | 10/2012 | Vulava | 312/404 |

FOREIGN PATENT DOCUMENTS

KR 10-2009-0046233 5/2009

* cited by examiner

*Primary Examiner* — Daniel J Troy
*Assistant Examiner* — Andres F Gallego
(74) *Attorney, Agent, or Firm* — Fish & Richardson P.C.

(57) ABSTRACT

A refrigerator includes a cabinet including a storage chamber, a door configured to open and close the storage chamber sliding-movably, and a guide member coupled to the door to prevent the door from shaking in a predetermined direction different from the direction of the door opening. The guide member is sliding-movable with respect to a bottom surface of the storage chamber.

18 Claims, 6 Drawing Sheets

REFRIGERATOR

CROSS REFERENCE TO RELATED APPLICATION

This application claims the benefit of Korean Patent Application No. 10-2009-0066837, filed on Jul. 22, 2009, which is hereby incorporated by reference as if fully set forth herein.

BACKGROUND OF THE DISCLOSURE

1. Field of the Disclosure

The present invention relates to a refrigerator, more particularly, to a refrigerator capable of preventing rightward/leftward shaking of a door configured to sliding-move to open and close a storage chamber.

2. Discussion of the Related Art

In general, refrigerators are electric appliances used to preserve storing objects fresh in a refrigerated or frozen stage.

Such a refrigerator includes a freezing chamber, a refrigerating chamber and a door configured to open and close the freezing and refrigerating chambers. Depending to a type of a structure, doors may be rotatably provided to open and close the freezing and refrigerating chambers. Alternatively, a rotatable door is provided to open the refrigerating chamber and a forward/backward sliding-movable door may be provided to open and close the freezing chamber.

Especially, a bottom freezer type having a refrigerating chamber arranged in a top portion of a cabinet and a freezing chamber arranged a bottom portion thereof is applied to many of refrigerators used in the U.S.A and Europe, in consideration of frequent usage of the refrigerating chamber.

Under this structure, a rotatable door is provided in the top portion of the cabinet to open and close the refrigerating chamber and a sliding-movable door is provided in the bottom portion of the cabinet to open and close the freezing chamber.

Especially, in case of the door for opening and closing the freezing chamber, a guide rail is extended backward from both sides of the door and the guide rail is connected to supporting parts provided both sides of the freezing chamber to enable the door to sliding-move.

However, the thickness or weight of the guide rail is remarkably small in comparison to the size or weight of the door. Because of that, the door would shake from side to side when it sliding-moves forward and backward and this cannot be prevented at all.

If the door moves rightward and leftward, the guide rails provided in right and left sides of the door will not move together with the door. As a result, one side guide rail happens to move more or less than the other side one.

Because of that, the freezing chamber door might be arranged obliquely enough to fail to close the freezing chamber completely and it has to be pulled forward for both of the guide rails to have corresponding motion or locations disadvantageously.

SUMMARY OF THE DISCLOSURE

Accordingly, the present invention is directed to a refrigerator.

An object of the present invention is to provide a refrigerator which can prevent a door configured to open and close a storage chamber sliding-movably from shaking rightward and leftward.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator includes a cabinet comprising a storage chamber; a door configured to open and close the storage chamber sliding-movably; and a guide member coupled to the door to prevent the door from shaking in a predetermined direction different from the direction of the door opening, the guide member sliding-movable with respect to a bottom surface of the storage chamber.

The storage chamber may include a refrigerating chamber provided in a top portion of the cabinet; and a freezing chamber provided in a bottom portion of the cabinet, and the door sliding-movably opens and closes the freezing chamber and the guide member is sliding-movable with respect to a bottom surface of the freezing chamber.

An end of the guide member may be provided in a rear surface of the door and the other end of the guide member may be extended toward a rear surface of the freezing chamber.

The refrigerator may further include a supporting member provided in the bottom surface of the freezing chamber, supporting side surfaces of the guide member, to prevent the guide member from shaking rightward and leftward.

The refrigerator may further include a projection provided in a rear end of the guide member; and a protrusion provided in an entry of the supporting member to make the projection caught thereby and to prevent the guide member from separating from the supporting member.

The guide member may further include a first supporting member and a second supporting member which are installed in both sides of the guide member, and the protrusion is projected toward an inside space formed between the first and second supporting members from a front end of the first and second supporting members, respectively;

and the projection is projected from a rear end of the guide member toward an outer direction of both side surfaces of the guide member.

A plurality of guide members may be provided and the plurality of the guide members are arranged in rear of the door in parallel, and a plurality of supporting members may be provided on the bottom surface of the freezing chamber to correspond with the plurality of the guide members.

In another aspect of the present invention, a refrigerator includes a door configured to open and close a storage chamber provided in a cabinet of the refrigerator, moving forward and backward; a rail member sliding-movably provided in an inner wall of the storage chamber to guide the motion of the door, the rail member connected with the door; a guide member coupled to the door, sliding-movable with respect to a bottom surface of the storage chamber; and a supporting member provided in the storage chamber to guide the motion of the guide member, the supporting member configured to support the guide member to prevent the guide member from shaking rightward and leftward.

The guide member may be coupled to a rear surface of the door, extended backward from the door and the supporting member is provided to support both side surfaces of the guide member.

The refrigerator may further include a projection provided in a rear end of the guide member; and a protrusion provided in an entry of the supporting member to make the projection caught thereby to prevent the projection from separating from the supporting member.

The projection may be projected from the rear end of the guide member toward an outer direction of both sides of the guide member and the protrusion may be extended from a front end of the supporting member toward an inside of the supporting member, located more ahead than the projection.

The supporting member may include a first supporting member and a second supporting member which are spaced apart a predetermined distance from each other; the protrusions may be extended from front ends of the first and second supporting members toward each other, spaced apart a predetermined distance from each other; the width of the projection may be corresponding to the distance of inner surfaces of the first and second supporting members, with right and left ends of the projection supported by the inner surfaces of the first and second supporting members; and the distance spaced between the protrusions provided in the first and second supporting members is corresponding to the right-and-left width of the guide member for right and left side surfaces of the guide member to be supported by the protrusions, respectively.

The refrigerator may further include a coupling plate provided in a front end of the guide member to contact with a rear surface of the door; and a coupling member configured to couple the coupling plate to the rear surface of the door.

A plurality of guide members may be provided on a rear surface of the door, spaced apart a predetermine distance from each other, and a plurality of supporting members may be provided corresponding to the plurality of the guide members, spaced apart a predetermined distance from each other to support the sliding motion of the guide members.

According to the present invention, the door configured to open and close the storage chamber sliding-movably may be prevented from shaking rightward and leftward.

As a result, the door may be prevented from arranged obliquely with respect to a front surface of the storage chamber and it is not necessary to adjust the location of the door additionally. User convenience may be enhanced advantageously.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
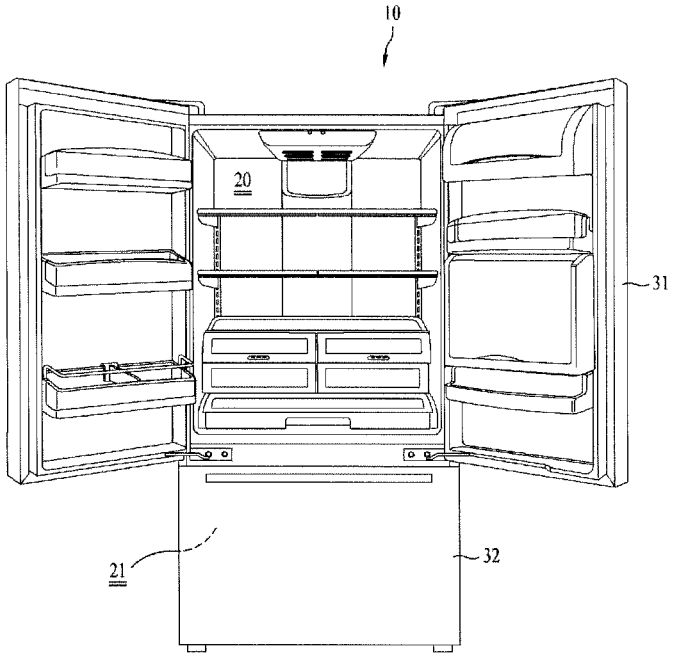
FIG. 1 is a front view of a refrigerator according to the present invention.
Figure 2:
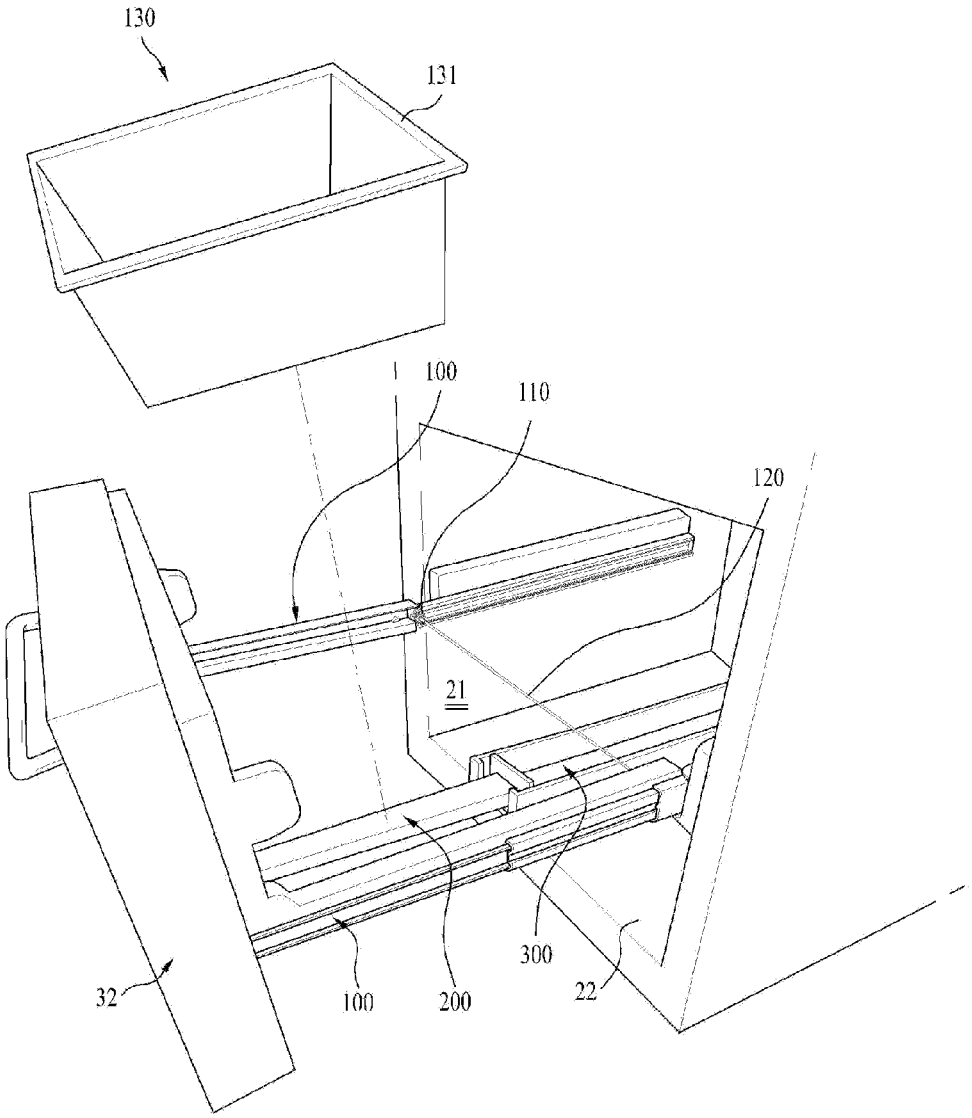
FIG. 2 is a side perspective view of a freezing chamber door provided in the refrigerator.

As shown in FIG. 1, a refrigerating chamber 20 is provided in a top portion of a cabinet 10 and a freezing chamber 21 is provided in a bottom portion of the cabinet 10. Refrigerating chamber doors 31 are provided in both sides of the top portion of the cabinet 10 to open and close the refrigerating chamber 20, respectively.

A freezing chamber door 32 is provided in a front of the bottom portion of the cabinet to open and close the freezing chamber 21 sliding-movably.

Rail members 100 extended backwardly from both sides of the freezing chamber door 32, respectively, and sliding-movable guide parts are provided in both inner side surfaces of the freezing chamber 21 to guide the motion of the rail members 100, respectively.

Gear members 110 are provided in rear ends of the rail members 100 and a connecting shaft 120 is provided between the gear members 110 to connect the gear members 110 with each other.

A storage box 130 is provided between the both rail members 100 to store storing objects. A rim part 131 is provided on a top of the storage box 130 and a front portion of the rim part 131 is placed in a rear portion of the freezing chamber door 32 and both sides of the rim part 131 are placed on top surfaces of the rail members 100.

The rear portion of the rim part 131 is placed on the connecting shaft 120 not to move.

A guide member 200 extended backward is provided in a rear-lower portion of the door 32 and the guide member 200 is arranged toward an inner bottom surface of the freezing chamber 21.

A supporting member 300 in which the guide member 200 will be sliding-movably inserted is provided in the inner bottom surface 22 of the freezing chamber 21. The supporting member 300 is located adjacent to both opposite sides of the guide member 200 to guide the motion of the guide member 200 as well as to prevent the guide member 200 from moving rightward and leftward.

Because of this structure, the freezing chamber door 32 may be prevented from shaking in right and left direction, that is, from side to side.

Figure 3:
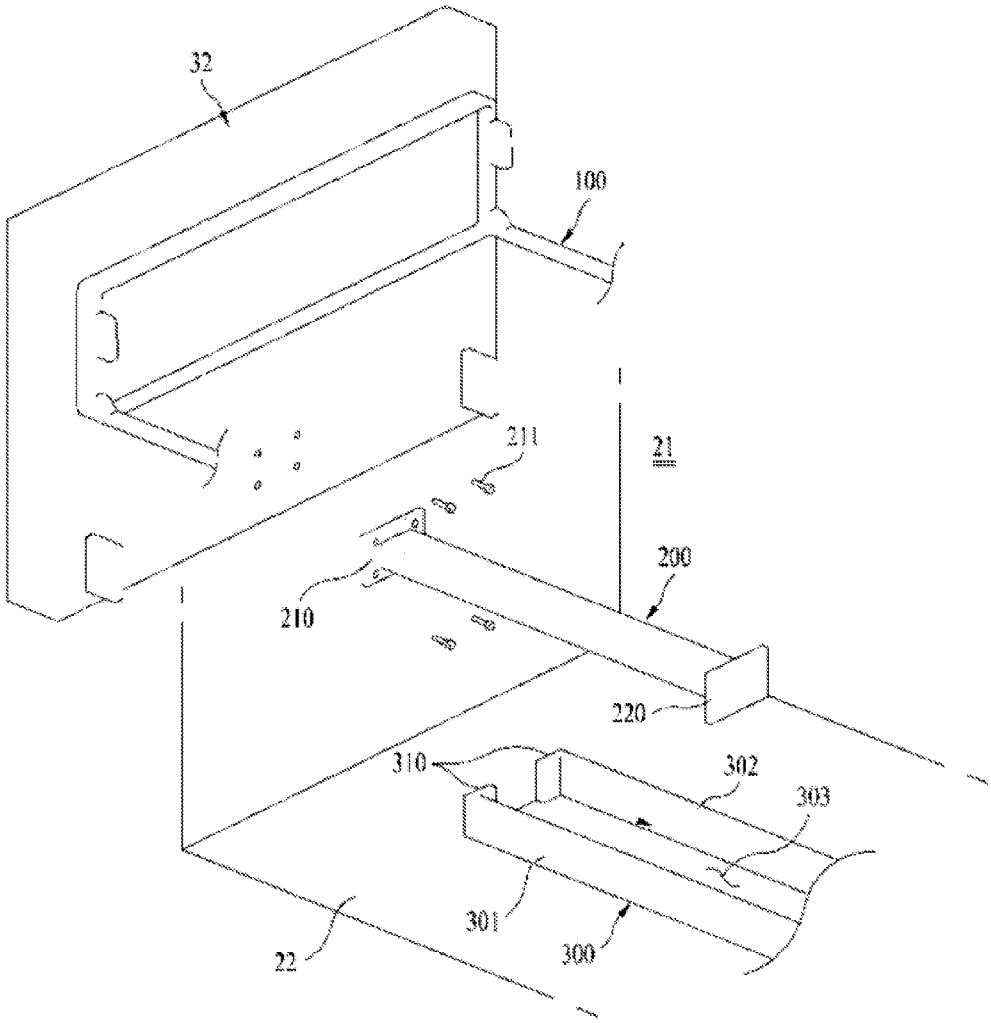
FIG. 3 is a perspective view illustrating a guide member and a supporting member according to an embodiment of the present invention.

As shown in FIG. 3, an end of the guide member 200 is coupled to a rear surface of the freezing chamber door 32. For that, a coupling plate 210 is provided in the end of the guide member 200 and the coupling plate 210 and the rear surface of the freezing chamber door 32 are coupled by a coupling member 2111 such as a bolt.

The other end of the guide member 200 is arranged toward a rear surface of the freezing chamber 21.

The supporting member 300 is provided in the bottom surface 22 of the freezing chamber 21 and it includes first and second supporting members 301 and 302 arranged in both sides of the guide member 200, respectively. A path 303 is formed between the first and second supporting members 301 and 302 to move the guide member 200 there along.

As a result, when a user pulls or pushes the freezing chamber door 32, the guide member 200 moves along the path 303 formed by the supporting member 300.

Here, it is required to prevent the guide member 200 from separating from the supporting member 300 because the freezing chamber door 32 is sliding-moved forward too much.

For that, a projection 220 is extended from both sides of the rear end of the guide member 200.

A protrusion 310 extended or projected toward the inside of the path 303 is provided in an entry of the path 303 formed by the first and second supporting members 301 and 302.

The protrusion 310 provided in the first supporting member 301 and the protrusion 310 provided in the second supporting member 302 are extended toward each other, spaced apart a predetermined distance from each other.

Under this configuration, in case the freezing chamber door 32 is sliding-moved outward, the projection 220 is moved toward the protrusion 210 to be stopped by the protrusion 310 such that the motion of the projection 220 may be limited.

The protrusion 310 may be located more ahead than the projection 220.

For the guide member 200 to prevent the rightward-and-leftward shaking of the door 32, a side surface of the guide member 200 has to be supported by the supporting member 300.

Specifically, the right-and-left width of the projection 220 may be corresponding to the width of the path 303, that is, the distance between inner surfaces of the first and second supporting members 301 and 302. Because of that, right and left ends of the projection 220 may be supported by the inner surfaces of the first and second supporting members 301 and 302.

The distance spaced between the protrusions 310 may be corresponding to the width of the guide member 200. Because of that, right and left side surfaces of the guide member 200 may be supported by the protrusion 310. Here, the portion supported by the protrusion 310 is a portion between the coupling plate 210 and the projection 220.

As follows, the operation of the refrigerator according to the present invention will be described in reference to the accompanying drawings.

Figure 4:
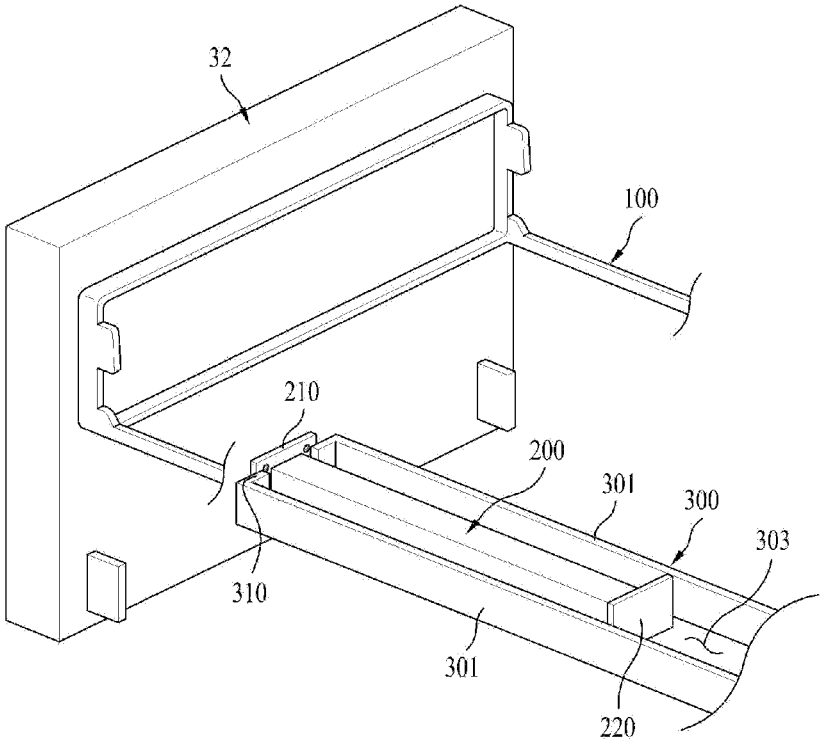
FIGS. 4 and 5 are perspective views illustrating operation of the freezing chamber door according to the present invention.

As shown in FIG. 4, according to a completely open state of the freezing chamber door 32 with respect to the freezing chamber 21, the front end of the guide member 20 contacts with the front end of the supporting member 300 and the rear end of the guide member 200 is located in an almost end portion of the supporting member 300.

If the user pulls the freezing chamber 32 forward in this state, the guide member 200 also moves forward and at this time the supporting member 300 contacts with both side surfaces of the guide member 200 to prevent the supporting member from moving rightward and leftward.

The right-and-left width of the guide member 200 may be noticeably thicker than that of the rail member 100 such that the rightward-and-leftward shaking may be prevented.

Figure 5:
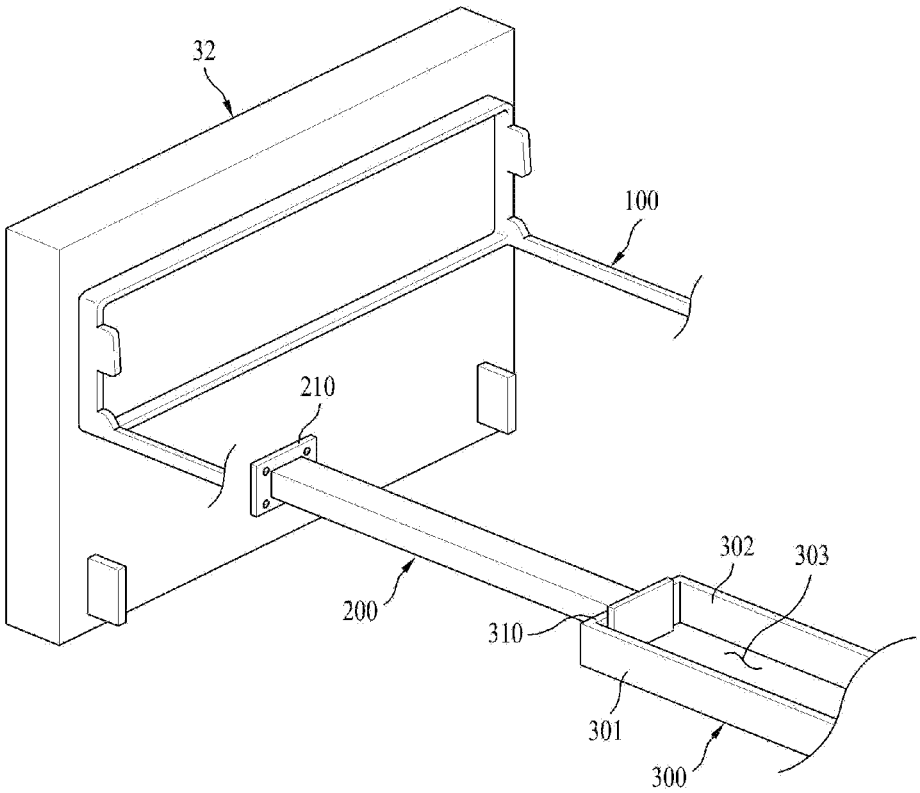

If the user moves forward the freezing chamber door 32 as shown in FIG. 5, the projection of the guide member 200 is stopped from moving farther by the protrusion 310 of the supporting member 300 and the freezing chamber door 32 is stopped from moving farther accordingly.

Figure 6:
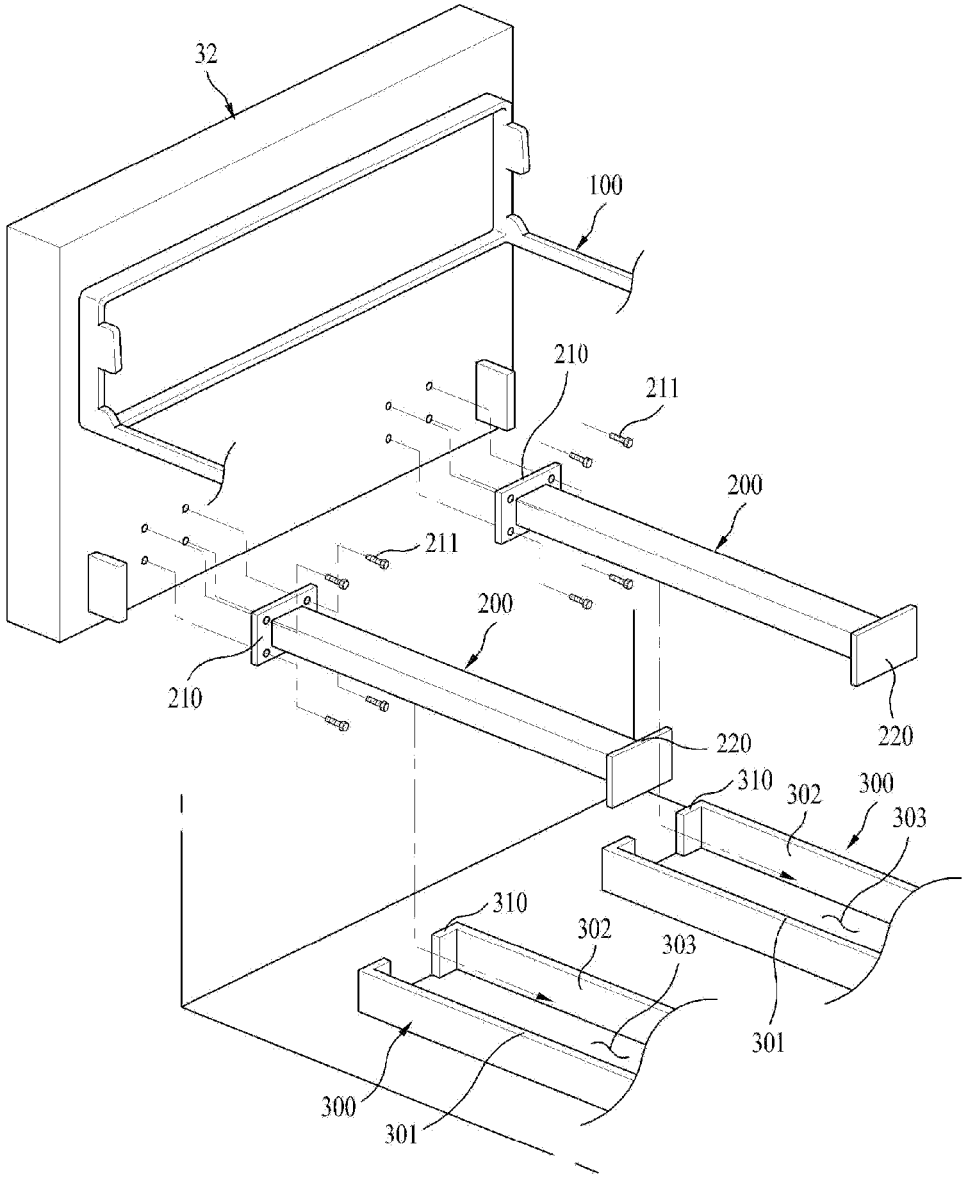
FIG. 6 is a perspective view illustrating a guide member and a supporting member according to another embodiment of the present invention.

FIG. 6 is a diagram illustrating a configuration to affirm the rightward-and-leftward shaking prevention effect for the freezing chamber door. Here, the plurality of the guide members 200 and the plurality of the supporting member 300 may be provided.

That is, the guide members 200 are arranged distant from each other in parallel and the supporting members 300 are arranged on the bottom surface 22 of the freezing chamber 21 to correspond with the guide members 200.

The configuration of the projection 220 provided in the guide member 200 and the configuration of the protrusion 310 provided in the supporting member 300 may be identical to those presented in this embodiment. In addition, there is almost no difference between the interrelation of the guide member 200 and the supporting member 300 according to above embodiment and an interrelation according to this embodiment when the freezing chamber door is moved forward. As a result, detailed description of those configurations will be omitted.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator comprising:

a cabinet comprising a storage chamber;

a door configured to open and close the storage chamber by sliding;

rail members provided in both inner sidewalls of the storage chamber to guide motion of the door, the rail members connected with both sides of the door, respectively, and the rail members being configured to slide with the door;

a guide member coupled to the door to reduce shaking of the door in a predetermined direction different from a direction of the door opening, the guide member being located at a central portion of a bottom surface of the storage chamber and being configured to slide with the door; and a supporting member provided in the central portion of the bottom surface of the storage chamber, and configured to support both side surfaces of the guide member to reduce shaking of the guide member in rightward and leftward directions.

2. The refrigerator of claim 1, further comprising gear members provided in rear ends of the rail members and a connecting shaft provided between the gear members to connect the gear members with each other.

3. The refrigerator of claim 2, further comprising a storage box provided between the rail members and configured to store objects.

4. The refrigerator of claim 3, wherein a rim part is provided on a top of the storage box, a front portion of the rim part is placed in a rear portion of the door, both sides of the rim part are placed on top surfaces of the rail members, and a rear portion of the rim part is placed on the connecting shaft.

5. The refrigerator of claim 1, wherein the storage chamber comprises a refrigerating chamber provided in a top portion of the cabinet; and a freezing chamber provided in a bottom portion of the cabinet, and the door sliding-movably opens and closes the freezing chamber and the guide member is sliding-movable with respect to a bottom surface of the freezing chamber.

6. The refrigerator of claim 5, wherein an end of the guide member is provided in a rear surface of the door and the other end of the guide member is extended toward a rear surface of the freezing chamber.

7. The refrigerator of claim 1, further comprising:

a projection provided in a rear end of the guide member; and a protrusion provided in an entry of the supporting member to make the projection caught thereby and to prevent the guide member from separating from the supporting member.

8. The refrigerator of claim 7, wherein the guide member further comprises a first supporting member and a second supporting member which are installed in both sides of the guide member, and the protrusion is projected toward an inside space formed between the first and second supporting members from a front end of the first and second supporting members, respectively;

and the projection is projected from the rear end of the guide member toward an outer direction of both of the side surfaces of the guide member.

9. The refrigerator of claim 1, wherein a right-and-left width of the guide member is thicker than a right-and-left width of each of the rail members.

10. The refrigerator of claim 9, wherein the right-and-left width of the guide member is more than twice as thick as the right-and-left width of each of the rail members.

11. The refrigerator of claim 1, wherein the rail members and the guide member define a triangle between points of connection to the door.

12. The refrigerator of claim 1, wherein the guide member is the only guide member provided on the bottom surface of the storage chamber and the guide member is made as a single part.

13. A refrigerator comprising:

a door configured to open and close a storage chamber provided in a cabinet of the refrigerator, and configured to move forward and backward;

rail members sliding-movably provided in both inner sidewalls of the storage chamber to guide motion of the door, the rail members connected with both sides of the door, respectively;

a guide member coupled to the door, sliding-movable with respect to a central portion of a bottom surface of the storage chamber; and a supporting member provided in the central portion of the bottom surface of the storage chamber to guide the motion of the guide member, the supporting member configured to support both side surfaces of the guide member to reduce shaking of the guide member in rightward and leftward directions.

14. The refrigerator of claim 13, wherein the guide member is coupled to a rear surface of the door, extended backward from the door.

15. The refrigerator of claim 14, further comprising:

a projection provided in a rear end of the guide member; and a protrusion provided in an entry of the supporting member to make the projection caught thereby to prevent the projection from separating from the supporting member.

16. The refrigerator of claim 15, wherein the projection is projected from the rear end of the guide member toward an outer direction of both sides of the guide member and the protrusion is extended from a front end of the supporting member toward an inside of the supporting member, located more ahead than the projection.

17. The refrigerator of claim 16, wherein the supporting member comprises a first supporting member and a second supporting member which are spaced apart a predetermined distance from each other;

the protrusions are extended from front ends of the first and second supporting members toward each other, spaced apart a predetermined distance from each other;

the width of the projection is corresponding to the distance of inner surfaces of the first and second supporting members, with right and left ends of the projection supported by the inner surfaces of the first and second supporting members; and the distance spaced between the protrusions provided in the first and second supporting members is corresponding to the right-and-left width of the guide member for right and left side surfaces of the guide member to be supported by the protrusions, respectively.

18. The refrigerator of claim 14, further comprising:

a coupling plate provided in a front end of the guide member to contact with the rear surface of the door; and a coupling member configured to couple the coupling plate to the rear surface of the door.

* * * * *